US005136742A

United States Patent [19]

Stebbins et al.

[11] Patent Number: 5,136,742

[45] Date of Patent: * Aug. 11, 1992

[54] NURSING HOME BED TILT APPARATUS

[76] Inventors: Dick Stebbins; Scott Stebbins, both of 600 E. Whaley, Longview, Tex. 75601

[ * ] Notice: The portion of the term of this patent subsequent to Jun. 26, 2007 has been disclaimed.

[21] Appl. No.: 543,345

[22] Filed: Jun. 25, 1990

Related U.S. Application Data

[63] Continuation-in-part of Ser. No. 419,251, Oct. 6, 1989, Pat. No. 4,935,974.

[51] Int. Cl.[5] ..... A61G 7/015; A61G 7/018; A61G 7/005

[52] U.S. Cl. ..... 5/618; 5/616; 5/610; 5/611

[58] Field of Search ..... 5/62, 63, 64, 60, 65, 5/11, 61

[56] References Cited

U.S. PATENT DOCUMENTS

| | | | |
|---|---|---|---|
| 3,073,635 | 1/1963 | Schaefer | 5/64 |
| 3,802,002 | 4/1974 | Jonas | 5/63 |
| 4,174,547 | 11/1979 | Wetzler | 5/63 |
| 4,425,673 | 1/1984 | Werner | 5/64 |
| 4,638,516 | 1/1987 | Vrazlik | 5/64 |

*Primary Examiner*—Alexander Grosz
*Attorney, Agent, or Firm*—Ronald B. Sefrna

[57] ABSTRACT

The present invention provides an apparatus for selectively raising and lowering the entire mattress of a nursing home or hospital bed without changing the angle or tilt thereof, raising and lowering the head of the mattress, and raising and lowering the foot of the mattress, all without affecting the longitudinal configuration of the mattress itself. The invention further provides a nursing home or hospital bed incorporating the apparatus of the invention, and still further provides a method of achieving the various possible mattress configurations enabled by the invention. The apparatus of the invention includes a lifting bar longitudinally disposed relative to the stationary frame of the bed of the invention, and interconnected between moveable mattress supporting components and the stationary frame of the bed through separately operable pivotal interconnections. Each interconnection between the lifting bar and the stationary bed frame is made through a first lever arm pivotally interconnected to the lifting bar, a pair of second lever arms pivotally interconnected to the stationary bed frame, and a torque tube rigidly interconnected between the first lever arm and the second lever arms.

15 Claims, 10 Drawing Sheets

NURSING HOME BED TILT APPARATUS

This application is a Continuation-In-Part of co-pending application Ser. No. 07/419,251, filed Oct. 6, 1989 now U.S. Pat. No. 4,935,974 by the same inventors and applicants.

FIELD OF THE INVENTION

The present invention generally relates to nursing home and hospital beds, and in certain of its embodiments more specifically relates to an apparatus adapted for the purpose of selectively elevating the head and foot of a nursing home or hospital bed either separately or in combination with the mattress in a flat configuration, and to a bed incorporating such tilt apparatus.

BACKGROUND OF THE INVENTION

The typical modern nursing home or hospital bed is provided with means for raising and lowering the mattress of the bed without changing the tilt of the mattress, for raising and lowering the head half of the mattress with a bend at its midpoint, and for raising and lowering the intermediate portion of the mattress underlying the knees of the patient. It is often desired or necessary for proper medical treatment procedures to elevate the patient's head or feet while maintaining the flat or planar configuration of the mattress itself, positions sometimes referred to as reverse Trendelenburg and as Trendelenburg, respectively. Various approaches to elevating the head or foot of the bed are known in the prior art, but each of the prior art approaches suffers from certain disadvantages.

In on such approach, one end of either the mattress support structure or the entire bed is raised by manual lifting, and propped at the desired position with blocks, bricks or the like placed between the mattress support structure and the bed frame or between the bed and the floor. While the simple expedient of propping up the mattress or the entire bed does allow elevation of one end of the mattress or bed, this approach has several disadvantages. The blocks used to prop the mattress or bed may be easily dislodged, allowing the elevated structure to fall to its rest position, with significant risk of injury to the patient. Further, especially when the entire bed is elevated at one end, it is difficult or impossible to move the bed without lowering the mattress to a horizontal position, and it is difficult to adjust the angle of elevation.

In another approach, the bed is provided with legs supporting it above the floor, and the legs are adapted to be adjustable in length, usually in pairs, as illustrated by U.S. Pat. No. 3,073,635 to Schaefer. In the Schaefer patent, the legs telescope into the head board and foot board of the bed, with the head pair of legs and the foot pair of legs selectively operable for tilting the plane of the entire bed frame. In another similar approach, illustrated by U.S. Pat. No. 3,802,002 to Jonas, the legs are of fixed length and are pivotally interconnected to a generally horizontal bed frame member. In the Jonas example, the elevation of either end of the bed may be adjusted by changing the angle between a respective pair of legs and the bed frame member. While effective for the particular purpose of elevating the bed, this approach may require adjustments to be made from various locations around the bed, depending upon the adjustment desired, and do not allow the mattress support or frame to be adjusted without changing the position of the entire bed frame.

A third approach known in the prior art, illustrated by U.S. Pat. No. 4,174,547 to Wetzler, utilizes a series of lever arms to rapidly raise and lower the head and/or the foot of the mattress supporting structure independent of the remainder of the bed structure, primarily in emergency situations. A pair of lever arms is associated with the head of the mattress structure, a second pair of lever arms is associated with the foot of the mattress structure, with each head lever arm connected to a foot lever arm by an elongate connecting rod. The lever arms are selectively rotated by means of a transverse concentric tube and rod assembly driven by a motor, and the head arms may be disconnected from the foot arms through a clutch arrangement. While reasonably effective for its intended purpose, the approach illustrated by the Wetzler patent requires a mechanically complex, and thus relatively costly, apparatus for operation.

There remains a need in the industry for a mechanically reliable, economical apparatus for the selective raising and lowering of the head and foot of a hospital or nursing home bed which is readily operable from a single point on the bed, and which does not interfere with movement of the bed or care of the patient reclining upon the bed.

SUMMARY OF THE INVENTION

The present invention provides an apparatus adapted for inclusion in the construction of nursing home and hospital patient beds to function in conjunction and cooperation with mechanisms for raising and lowering the full mattress, raising and lowering the head segment of the mattress, and raising and lowering the knee segment of the mattress, in order to efficiently provide the additional function of raising and lowering either the head or foot of the mattress to tilt the mattress while maintaining a flat, or planar, mattress configuration. More specifically, the apparatus of the invention provides a unified mechanism which allows the user thereof to selectively raise and lower either end of the mattress supporting structure and mattress or to raise and lower the entire mattress support and mattress without tilt, without affecting the structure or operation of mechanisms which may be provided for raising and lowering head and knee segments of the mattress.

The bed of the invention generally comprises a stationary frame; a moveable frame; the raising, lowering, and tilting apparatus of the invention, adjustably interconnected between the stationary frame and the moveable frame; a segmented and independently operable mattress support adjustably interconnected to the moveable frame; and a mattress disposed on the mattress support. The apparatus of the invention for selectively raising, lowering, and tilting the mattress support and mattress generally includes an elongate lifting bar; a pair of torque tubes, one associated with each end of the lifting bar; a pair of first lever arms, each pivotally interconnected at one end to a respective end of the lifting bar and rigidly interconnected at its opposite end to the associated torque tube; and two pair of second lever arms with each lever arm of each pair rigidly interconnected to one of the torque tubes near one end of the tube and pivotally interconnected to the stationary bed frame structure. Each torque tube is pivotally interconnected to the moveable frame of the bed structure, so that movement of the torque tubes produces corresponding movement of the moveable frame of the bed and thus of the mattress support and mattress disposed thereon. The first lever arms are disposed substantially perpendicular to the second lever arms, and are fixed in that perpendicular relationship through their rigid interconnections to the associated torque tube. Movement of the torque tubes is induced by movement of the lifting bar, which in the preferred embodiment is induced by activation of variable length actuating means interconnected between the lifting bar and the moveable frame of the bed. The variable length actuating means may be activated by rotation of a manual crank or may be activated by operation of an electric motor.

The lifting bar component of the apparatus of the invention comprises a center bar which telescopes at each end into the hollow respective interiors of a head bar at the head of the bed and a foot bar at the foot of the bed. The center bar is received within the head and foot bars in closely mating sliding relationship, and the first lever arms are pivotally interconnected to the respective head and foot bars. A separate locking mechanism is provided in association with each of the head bar and foot bars, in order to allow the center bar to be fixed relative to the respective head or foot bar, or to slide relative to the respective head or foot bar. In an alternative embodiment, which is adapted to allow selective elevation of the head or foot of the mattress support and mattress, the structure of the lifting bar is simplified and the locking mechanisms may be omitted.

The structure and operation of the apparatus and bed of the invention will be described in more detail with reference to the accompanying drawing figures.

DETAILED DESCRIPTION OF THE PREFERRED EMBODIMENT

Figure 1:
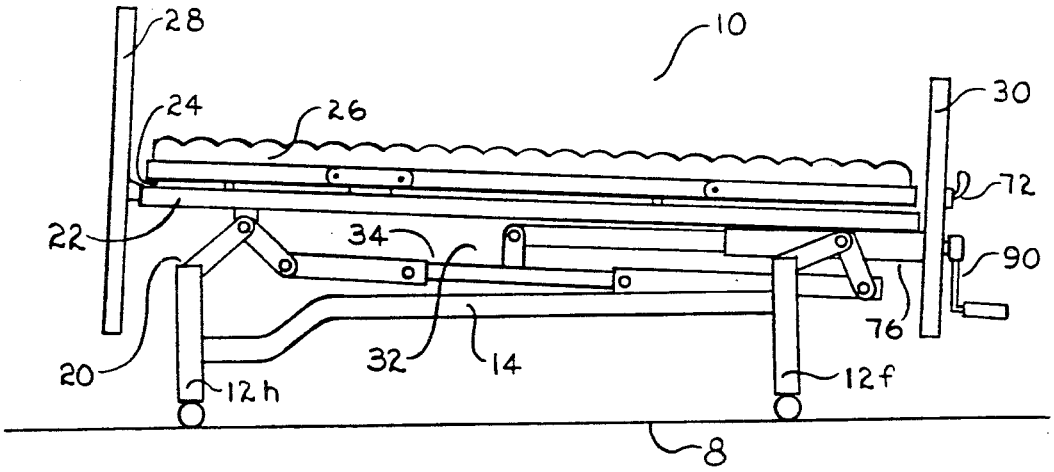
FIG. 1 is a side elevation view of a bed incorporating the apparatus of the invention with the head of the mattress raised to an elevated position.
Figure 2:
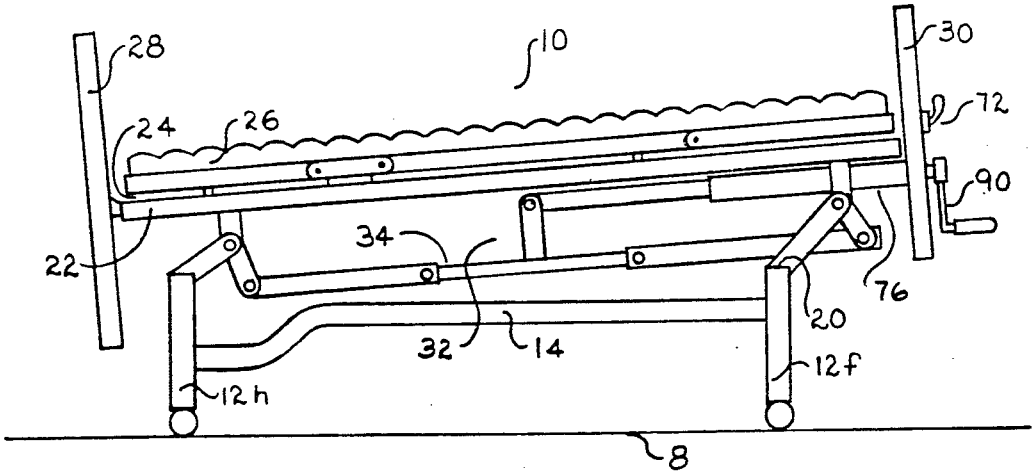
FIG. 2 is a side elevation view of a bed incorporating the apparatus of the invention with the foot of the mattress raised to an elevated position.
Figure 3:
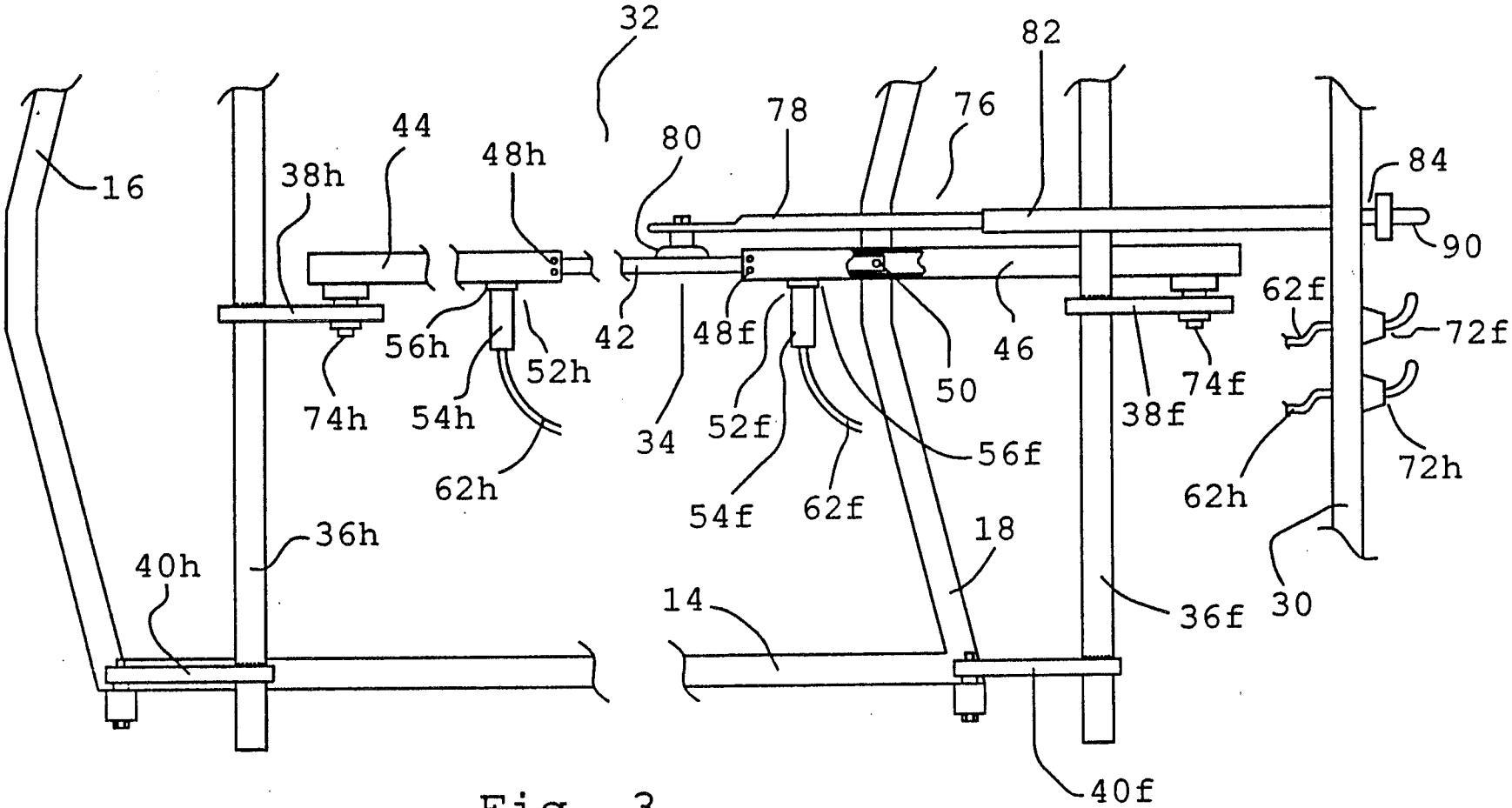
FIG. 3 is a partial plan view of the frame of a bed incorporating the preferred embodiment of the apparatus of the invention, configured so as to support the mattress in a horizontal plane, with the moveable frame, mattress support structure, and mattress omitted, and with mechanisms for segmentally adjusting the mattress support structure and mattress omitted.

With reference initially to FIGS. 1 and 2, and with additional reference to FIG. 3, the bed of the invention, generally designated by reference numeral 10, is shown upon a horizontal floor 8. Bed 10 includes a stationary frame generally comprising four discrete legs 12, a pair of elongate longitudinal beams 14, a transverse beam 16 at the head of the bed, and a transverse beam 18 at the foot of the bed. In the preferred embodiment depicted, each of longitudinal beams 14 is interconnected between two legs 12 in opposed relation across the longitudinal axis of bed 10, and transverse beams 16 and 18 are interconnected between the two legs associated with the head of the bed and the foot of the bed respectively. The interconnection of longitudinal beams 14 and of transverse beams 16 and 18 to each leg 12 is made intermediate the upper and lower ends of legs 12, such that the upper end 20 of each leg 12 extends upwardly above such interconnections.

Bed 10 further includes moveable frame 22, mattress support 24, and mattress 26, illustrated in FIGS. 1 and 2. A headboard 28 and a footboard 30 are rigidly interconnected to the respective head and foot ends of moveable frame 22, such that headboard 28 and footboard 30 move with moveable frame 22 during operation of the apparatus of the invention. In the typical embodiment of bed 10, mattress support 24 is transversely divided into segments pivotally interconnected end to end, in order to allow the head segment to be raised and lowered and in order to allow the segment under the knees of the patient to be raised and lowered relative to the other segments of the mattress support structure. The typical embodiment of bed 10 additionally includes mechanisms for raising and lowering the head and knee segments. For clarity, such conventional structures and mechanisms are largely omitted from the drawing figures and from the description of the invention, as the apparatus of the invention is specifically designed to operate independently of those mechanisms.

The apparatus of the invention for tilting the moveable frame, mattress support 24, and mattress 26, generally designated by reference numeral 32, includes the major components of elongate lifting bar 34, a pair of torque tubes 36, a pair of first lever arms 38, and two pair of second lever arms 40. One torque tube 36, one first lever arm 38, and one pair of second lever arms 40 is associated with each end of the bed 10, one end being the head of the bed and the opposite end being the foot of the bed, and lifting bar 34 is similar in structure at its two ends. Accordingly, in the following description and in the drawing figures, the designation "h" is used to indicate a component association with the head of the bed, and the designation "f" is used to indicate a component association with the foot of the bed, and when one designation is used in describing the structure of a component it will be understood that a corresponding component exists in association with the opposite end of the bed structure.

In the preferred embodiment of the invention lifting bar 34 is disposed longitudinally with respect to the stationary frame of bed 10 along a lateral midline thereof, and includes center bar 42, head bar 44, and foot bar 46, disposed in coaxial alignment with the first end of center bar 42 extending into the hollow interior of head bar 44 from the second end thereof, and the second end of center bar 42 extending into the hollow interior of foot bar 46 from the first end thereof, in closely mated sliding relationship. In the preferred embodiment of the invention, center bar 42, head bar 44, and foot bar 46 are square in cross-sectional configuration, but any cross-sectional configuration which allows the bars to move longitudinally relative to each other while preventing relative rotational movement may be utilized. During operation of the apparatus of the invention to tilt the mattress support of bed 10 center bar 42 is caused to telescope relative to either head bar 44 or foot bar 46, and lifting bar 34 preferably includes a plurality of slide bearings **48*h* extending into the interior of head bar 44 a short distance inward from its second end and a plurality of slide bearings 48*f* extending into the interior of foot bar 46 a short distance inward from its first end, to bear against the exterior surface of center bar 42 in order to stabilize center bar 42 relative to head bar 44 and foot bar 46 and to reduce friction as center bar 42 slides relative to either head bar 44 or foot bar 46. Lifting bar 34 further preferably includes a plurality of slide bearings 50, illustrated in FIG. 3, extending outwardly from the outer surface of center bar 42 a short distance inward from its first and second ends, to bear against the inner surfaces of head bar 44 and foot bar 46, to serve the same purpose as slide bearings 48. Slide bearings 48 and 50** may be constructed of nylon or other low friction, long wearing material.

Figure 7:
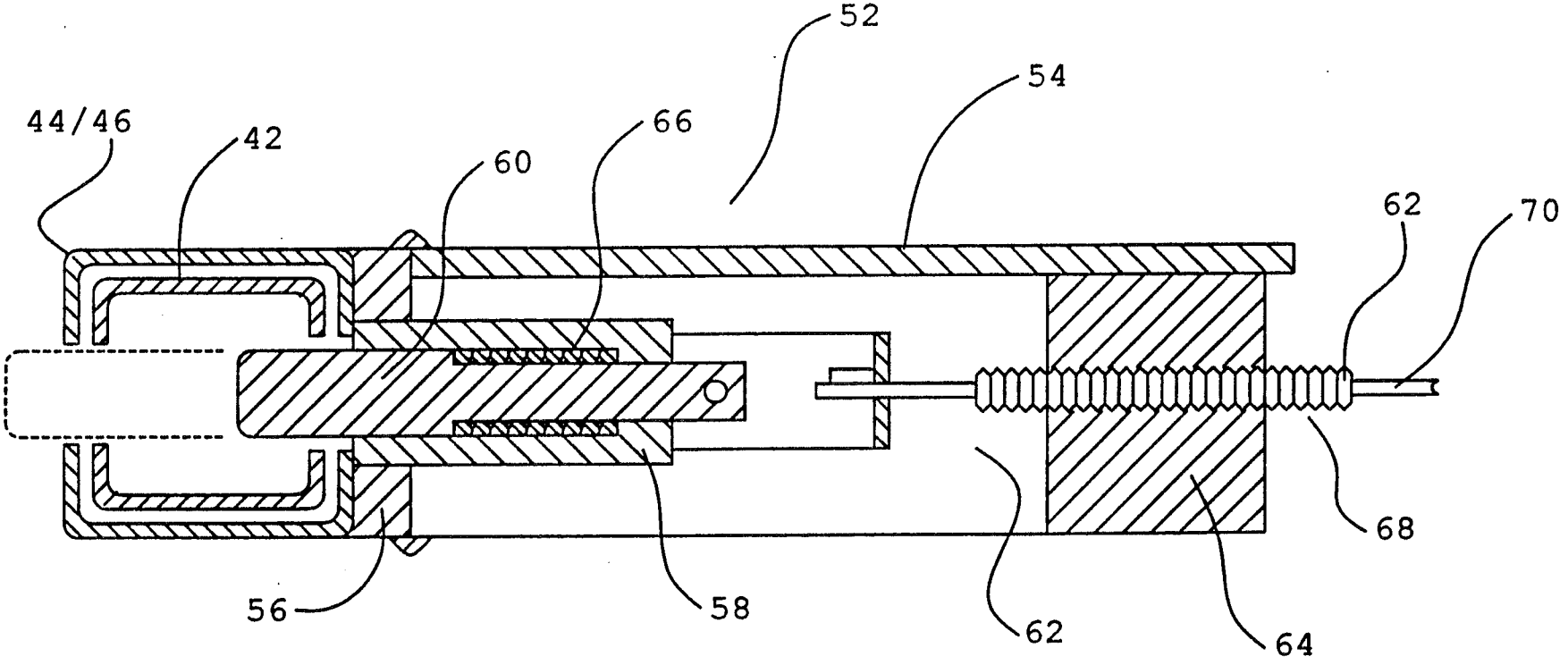
FIG. 7 is a cross-sectioned elevation view of the preferred embodiment of the locking mechanism of the apparatus of the invention, with the locking pin intermediate the fully locked and fully released positions.

In the preferred embodiment of the invention, lifting bar 34 includes locking mechanism **52*h* and locking mechanism 52*f*, for selectively locking the position of head bar 44, and of foot bar 46, respectively, relative to center bar 42. Each locking mechanism 52, depicted in FIG. 7, comprises an elongate housing 54, attachment plate 56, pin guide 58, locking pin 60, cable 62, and cable retainer 64. Housing 54 is preferably constructed of an angle section and is open on two sides, but it may be enclosed on three or all four sides with a hollow interior, or may be formed as a flat rigid plate, if desired. Attachment plate 56 is interconnected to one end of housing 54 with its plane perpendicular to the longitudinal axis of housing 54 and cable retainer 64 is interconnected to the opposite end of housing 54, with an open space between them. Attachment plate 56 is penetrated by a central aperture, and pin guide 58, comprising a hollow cylindrical tube open at its first end and closed at its second with an annular closure so as to provide an aperture of smaller diameter than the open first end, is interconnected to attachment plate 56 within or surrounding the central aperture and extends outwardly therefrom in the same direction as and parallel to the axis of housing 54. Locking pin 60 is a cylindrical pin with a first portion having a diameter slightly smaller than the central aperture of attachment plate 56 and a second portion with a diameter slightly smaller than the aperture of the annular closure of pin guide 58. Locking pin 60, which is of greater length than pin guide 58, is slideably disposed in the interior thereof with its second portion extending through and rearwardly from the annular closure of pin guide 58, and is biased toward a position with the first portion of locking pin 60 extending through and outwardly from the central aperture of attachment plate 56 by means of coil spring 66 surrounding the second portion of locking pin 60 and retained between the first portion of locking pin 60 and the annular closure of pin guide 58. Cable 62 comprises a hollow cable sheath 68, which is extended through and fixedly retained by cable retainer 64, and a moveable cable 70 extending through the interior of cable sheath 68. One end of moveable cable 70 is interconnected to the second end of locking pin 60 extending outwardly from pin guide 58, and the opposite end of moveable cable 70 is attached to an operating lever 72, for inducing longitudinal movement of moveable cable 70 relative to cable sheath 68 and of locking pin 60 relative to the other components of locking mechanism 52**.

A locking mechanism 52 is interconnected to each of head bar 44 and foot bar 46 with their longitudinal axes in perpendicular relation, as indicated in FIG. 3, in a position on each of such bars which overlies a portion of center bar 42 as it is disposed with mattress support 24 in an untilted configuration. Each of head bar 44 and foot bar 46, and the underlying portion of center bar 42 associated with each, is penetrated by aligned apertures in alignment with locking pin 60, so that locking pin 60 may be extended fully through said apertures to lock center bar 42 relative to head bar 44 and/or foot bar 46 as indicated by the dashed lines of FIG. 7, or withdrawn therefrom to unlock center bar 42 from head bar 44 or foot bar 46, by operation of the respective operating lever 72.

Figure 4:
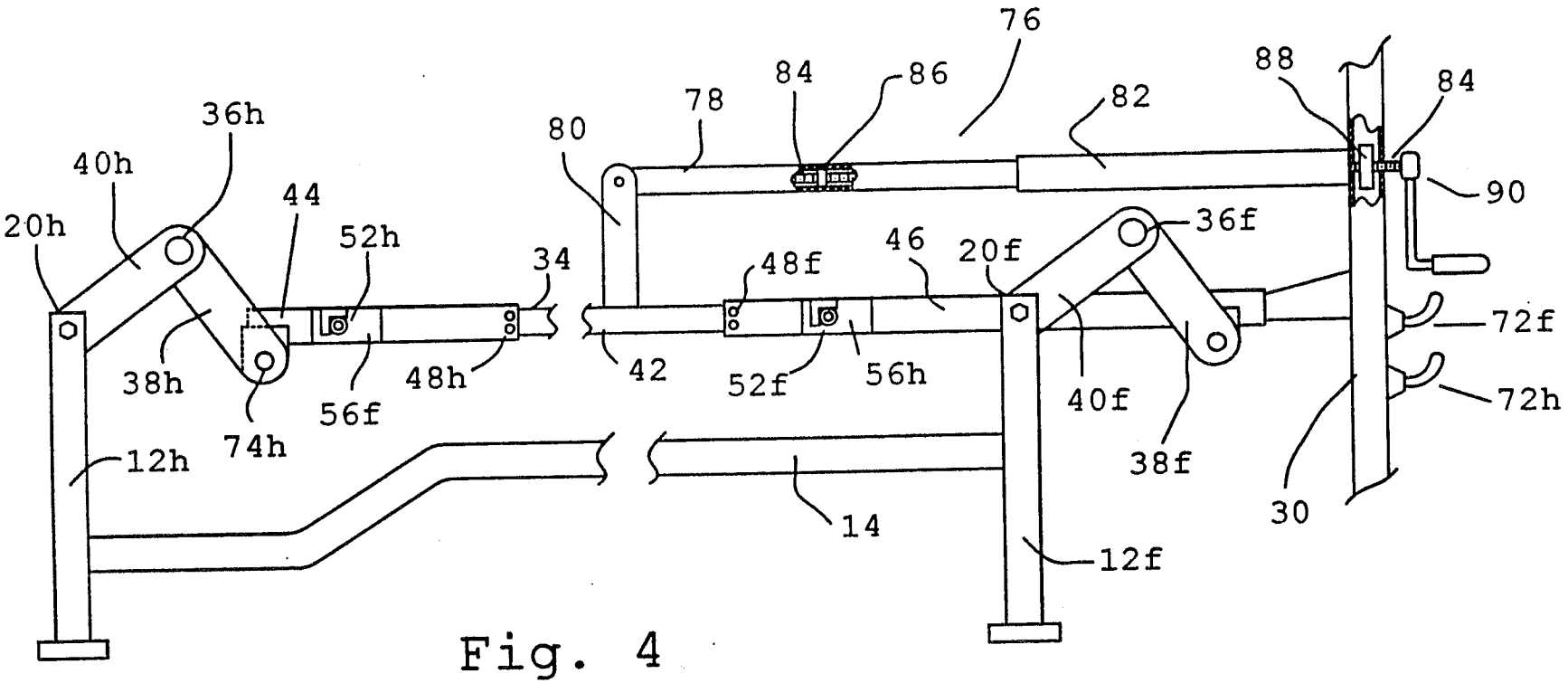
FIG. 4 is a side elevation view of the frame of a bed incorporating the preferred embodiment of the apparatus of the invention, configured so as to support the mattress in a horizontal plane, with the moveable frame, mattress support structure, and mattress omitted, and with mechanisms for segmentally adjusting the mattress support structure and mattress omitted.
Figure 5:
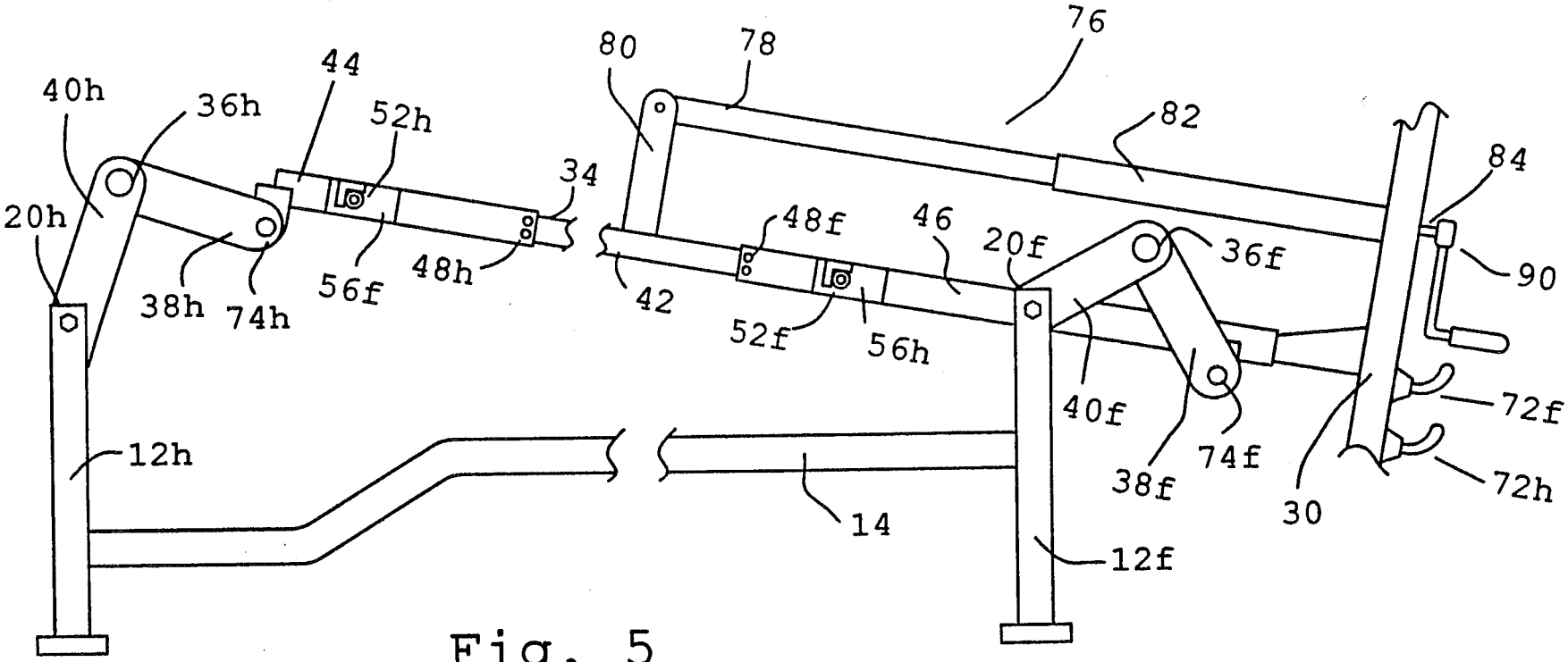
FIG. 5 is a side elevation view of the frame of a bed incorporating the preferred embodiment of the apparatus of the invention, configured with the head of the mattress in an elevated position, with the moveable frame, mattress support structure, and mattress omitted, and with mechanisms for segmentally adjusting the mattress support structure and mattress omitted.
Figure 6:
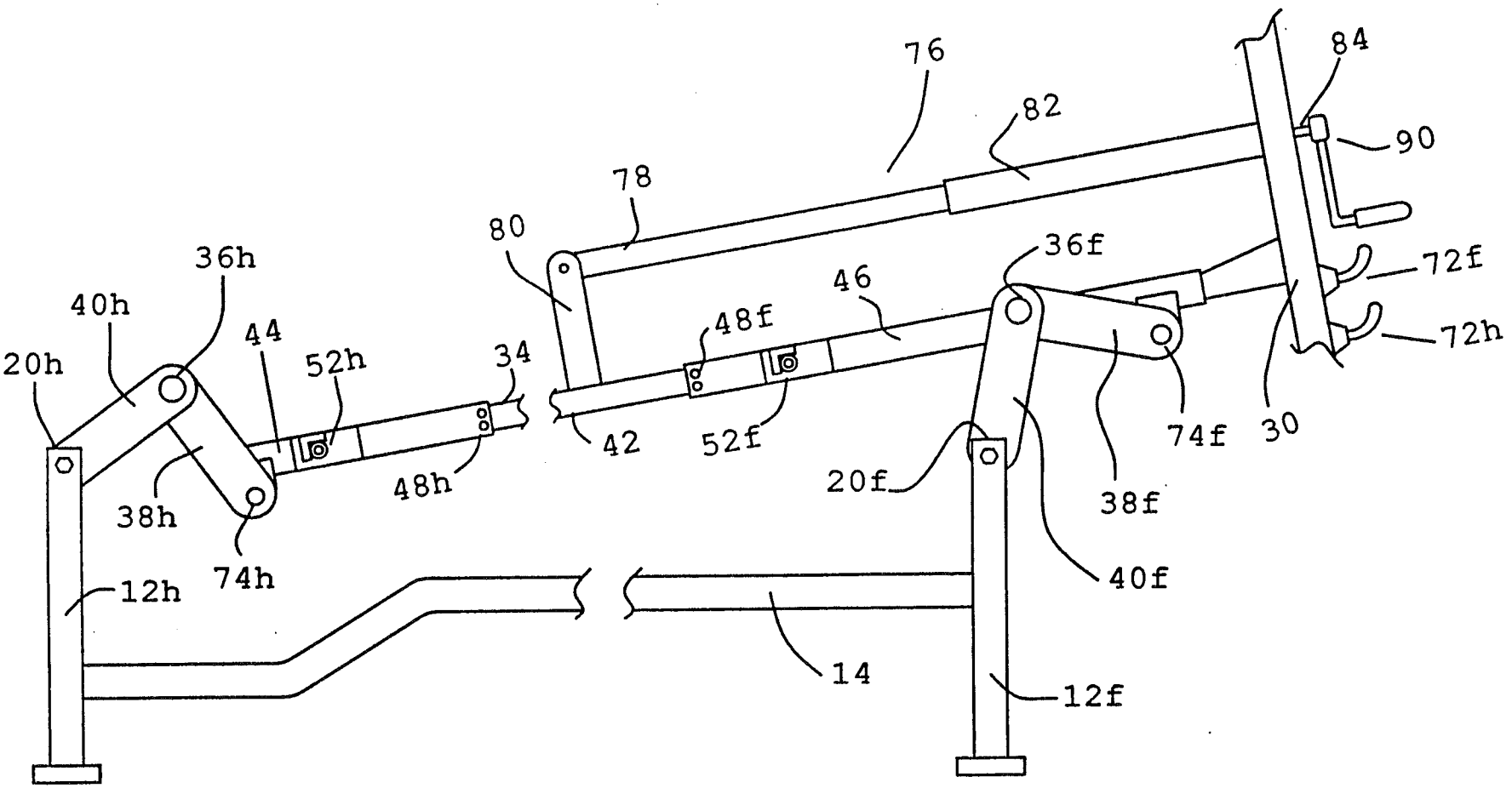
FIG. 6 is a side elevation view of the frame of a bed incorporating the preferred embodiment of the apparatus of the invention, configured with the foot of the mattress in an elevated position, with the moveable frame, mattress support structure, and mattress omitted, and with mechanisms for segmentally adjusting the mattress support structure and mattress omitted.

Lifting bar 34 is interconnected to torque tubes **36*h* and 36*f* by first lever arms 38*h* and 38*f*, respectively. In the preferred embodiment, each torque tube 36 comprises an elongate cylindrical tube disposed perpendicular to the longitudinal axis of bed 10 and extending fully across the width of the stationary frame of bed 10. Each of lever arms 38 comprises an elongate plate penetrated by an aperture at each end, and is pivotally interconnected to the respective head bar 44, at the first end thereof, or foot bar 46 at the second end thereof by first pivot pins 74*h* and 74*f* extending through the first of such lever arm apertures and rigidly interconnected to the respective component of lifting bar 34. Each torque tube 36 is extended through the second aperture of its associated first lever arm and rigidly interconnected thereto near the midpoint of each torque tube. Each torque tube 36 is pivotally interconnected to the upper end of the the two legs 12***h* or 12*f*, respectively, by means of a pair of second lever arms 40*h* or 40*f* rigidly interconnected to each torque tube 36 and pivotally interconnected to legs 12. Each second lever arm 40 is of the same configuration as each first lever arm 38, and each is interconnected to its respective torque tube 36 near the respective end thereof by extending torque tube 36 through an aperture at one end of the second lever arm 40 and forming a rigid interconnection therebetween. The interconnection between each second lever arm 40 and its associated leg 12 is made by means of second pivot pins extending through an aperture at the opposite end of the second lever arm 40 and interconnected to the upper end of the leg 12. The disposition of each first lever arm 38 and of each pair of second lever arms 40 relative to each torque tube 36 is such that the longitudinal axes of the pair of second lever arms 40 are mutually parallel and perpendicular to the longitudinal axis of the respective first lever arm 38, as depicted in FIGS. 4, 5, and 6.

Tilting apparatus 32 further includes actuating means 76 for inducing longitudinal movement of center bar 42, and thus of head bar 44 and/or foot bar 46 operatively interconnected thereto by locking mechanism 52*h* and/or 52*f*, respectively, during operation of the apparatus of the invention. The preferred embodiment of actuating means 76 comprises first hollow tube 78 interconnected at its first end to center bar 42 through connector plate 80, second hollow tube 82, and threaded rod 84, all disposed in coaxial alignment. The second end of first tube 78 is received in the hollow interior of second tube 82 through the first end thereof in telescoping relation, and threaded rod 84 extends into the second end of second tube 82, fully through the interior thereof, and into the interior of first tube 78 through threaded nut 86 rigidly interconnected to the interior surface of first tube 78. The second end of second tube 82 is interconnected to footboard 30 which is, in turn, interconnected to the foot end of moveable frame 22, and the second end of threaded rod 84 extends through an aperture in footboard 30 and is retained therein by thrust bearing 88 so as to allow rotational movement of threaded rod 84 relative to footboard 30 while preventing relative longitudinal movement. In the preferred embodiment, rotation of threaded rod 84 is induced manually by handle 90 interconnected to its second end. Rotational movement of first tube 78 is restrained by its interconnection to center bar 42, and as threaded rod 84 is rotated, longitudinal movement of first tube 78 relative to threaded rod 84 and second tube 82 is induced by movement of nut 86 along such rod, thereby inducing longitudinal movement of center bar 42 for activation of the tilting apparatus as described below.

Figure 8:
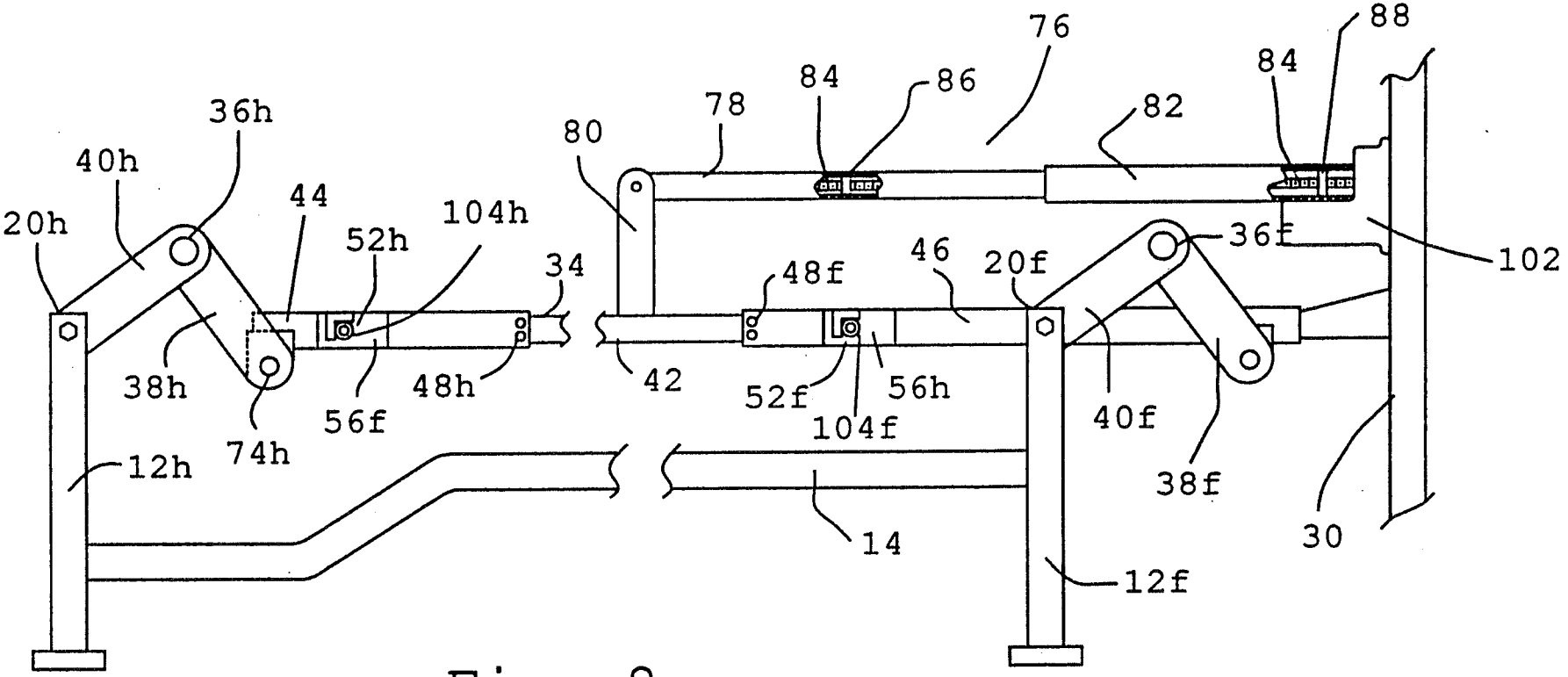
FIG. 8 is a side elevation view of the frame of a bed incorporating a first alternative embodiment of the apparatus of the invention, activated by an electric motor, configured so as to support the mattress in a horizontal plane, with the moveable frame, mattress support structure, and mattress omitted, and with mechanisms for segmentally adjusting the mattress support structure and m omitted.

In a first alternative embodiment of the apparatus of the invention, illustrated in FIG. 8, rotation of threaded rod 84 is induced by reversible electric motor 102 instead of by handle 90, and the structural relationship between the second end of threaded rod 84 and footboard 30 is altered accordingly. More specifically, the aperture in footboard 30 and handle 90 are omitted, second tube 82 and threaded rod 84 are shortened, and thrust bearing 88 is repositioned to the second end of second tube 82. Motor 102 is interconnected to the inner face of footboard 30, the second end of second tube 82 is interconnected to motor 102 or to a mounting bracket for motor 102, and the second end of threaded rod 84 is operatively interconnected to a rotating output shaft of motor 102, either directly or through a conventional gear assembly.

Figure 9:
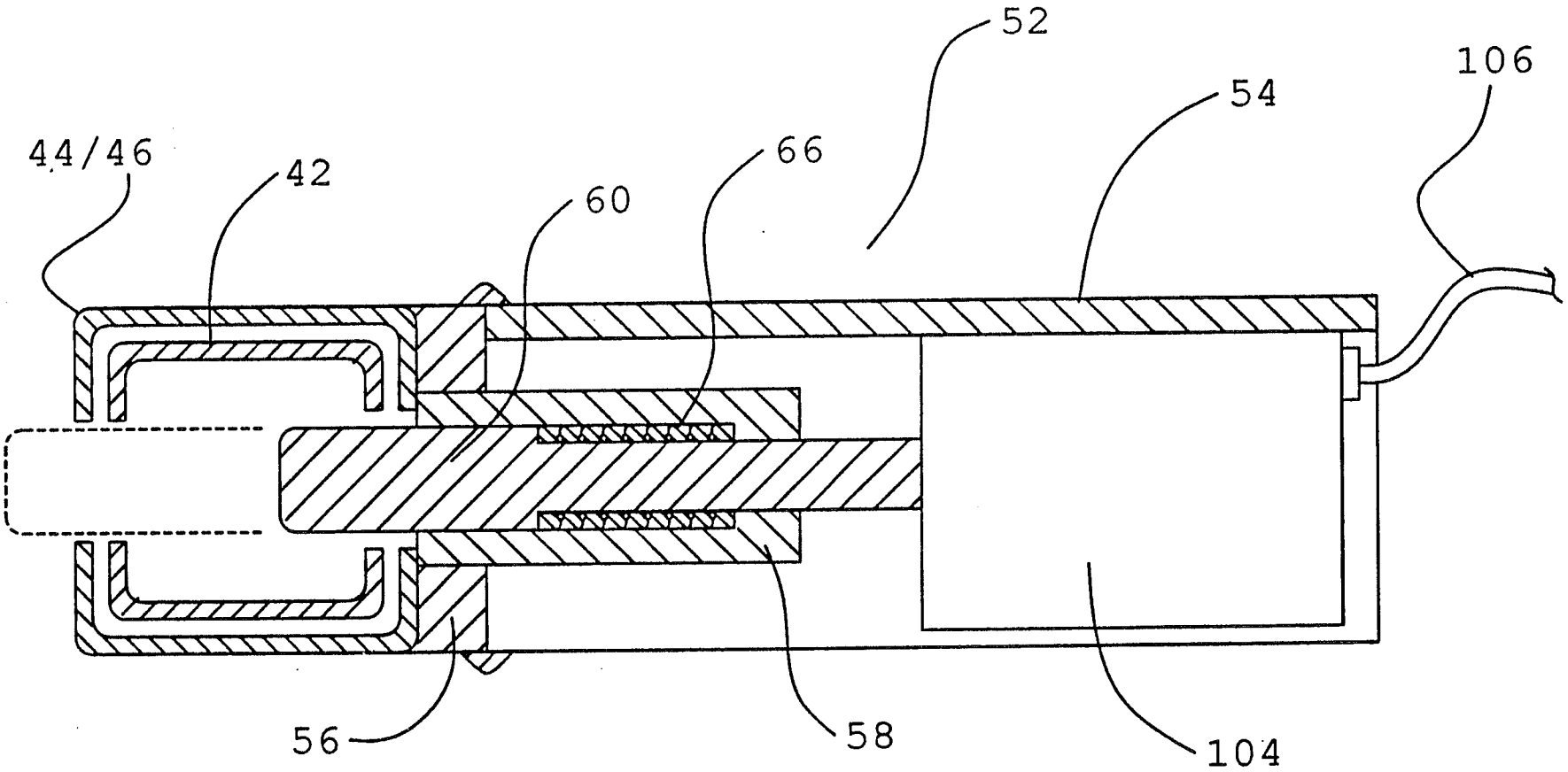
FIG. 9 is a cross-sectioned elevation view of an alternative embodiment of the locking mechanism of the apparatus of the invention, with the locking pin intermediate the fully locked and full released positions.

Since the first alternative embodiment employs an electric motor for activation, when that alternative embodiment is employed it may be desireable to replace the mechanical locking mechanisms 52 with alternative solenoid activated locking mechanisms, as illustrated in FIG. 9. In the alternative solenoid activated embodiment, cable 62 and cable retainer 64 are omitted, as is operating lever 72. An electrically activated solenoid 104 is interconnected to housing 54, and is provided with power and control wiring 106 extending from solenoid 104 to a control switch positioned at a convenient location on bed 10. The second portion of locking pin 60 is elongated to extend into the interior of solenoid 104, and is constructed of a material with suitable properties for reaction with the fields produced by solenoid 104, so that upon activation of solenoid 104 locking pin 60 is drawn along the axis of locking mechanism 52 against the force of coil spring 66 and disengaged from center bar 42 and the respective head bar 44 or foot bar 46.

Moveable frame 22 is attached to the stationary frame of bed 10 through the tilting apparatus 32, described above, by means of pivotal interconnections between moveable frame 22 and tilting apparatus 32. In the preferred embodiment, the head end of moveable frame 22 is pivotally interconnected to torque tube 36*h* and the foot end of moveable frame 22 is pivotally interconnected to torque tube 36*f*, so that movement of the torque tubes is transmitted directly to moveable frame 22, mattress support 24, and to mattress 26 resting thereon. Alternatively, moveable frame 22 may be pivotally interconnected to head bar 44 at its head end and pivotally interconnected to foot bar 46 at its foot end without departing from the scope of the invention, but it should be noted that additional stabilizing structure may be necessary in that event.

In use of the preferred and first alternative embodiments of the apparatus of the invention to raise both the head and foot of mattress support 24 and thus mattress 26 without tilt from a horizontal plane, locking pins 60 of locking mechanisms 52 are extended fully through the apertures of head bar 44 and foot bar 46 and center bar 42 to prevent relative movement therebetween, and threaded rod 84 of actuating means 76 is rotated so as to extend first tube 78 relative thereto and force lifting bar 34 toward the head of bed 10. The force imposed on lifting bar 34 induces rotation of first lever arms 38 and second lever arms 40 about their pivotal interconnections to lifting bar 34 and to legs 12 of the stationary frame of bed 10, which in turn results in a net vertical movement of lifting bar 34 and of torque tubes 36, and thus of moveable frame 22, mattress support 24, and mattress 26. Reversing the direction of rotation of threaded rod 84 results in a reversal of the movement of lifting bar 34, torque tubes 36, and moveable frame 22 to lower mattress support 24 and mattress 26. Headboard 28 and footboard 30 are interconnected to respective ends of moveable frame 22, as noted above, and raise and lower therewith.

To raise the head of the mattress, locking mechanism 52*f* is activated by operation of operating lever 72*f* or the solenoid control switch associated with alternative locking mechanism 52*f* to withdraw locking pin 60*f* from the aligned apertures of foot bar 46 and center bar 42, and allow center bar 42 to slide relative to foot bar 46. Threaded rod 84 is then rotated to impose force on center bar 42 toward the head of bed 10 through first tube 78. The force imposed on center bar 42 is transmitted to head bar 44, which is locked in position on center bar 42 by locking pin **60*h* of locking mechanism 52*h*, but the center bar 42 is allowed to slide relative to foot bar 46 without transmission of the force to foot bar 46. As a result, first lever arms 38*h* and second lever arms 40*h* are caused to rotate about their pivotal interconnections, raising the head end of lifting bar 34, torque tube 36*h* and the head end of moveable frame 22 to rise to an elevated position from its rest position. During the head-elevating operation first and second lever arms 38*f* and 40*f*, respectively, do not rotate, since the movement of center bar 42 is not transmitted through foot bar 46, so foot of moveable frame 22 remains in its rest position while head is raised. The head of moveable frame 22, and thus of support 24 and mattress 26, may be lowered by rotation of threaded rod 84**.

To raise and lower the foot of the locking mechanism **52*f* is locked and locking mechanism 52*h* is released, in the reverse of the procedure for raising the head. As threaded rod 84 is rotated center bar 42 slides relative to head bar 44 so that the first and second lever arms 38*h* and 40*h* will not rotate along with the first and second lever arms 38*f* and 40*f*, causing the foot of moveable frame 22, mattress 24, and mattress 26** to rise or fall while the head remains in rest position.

Figure 10:
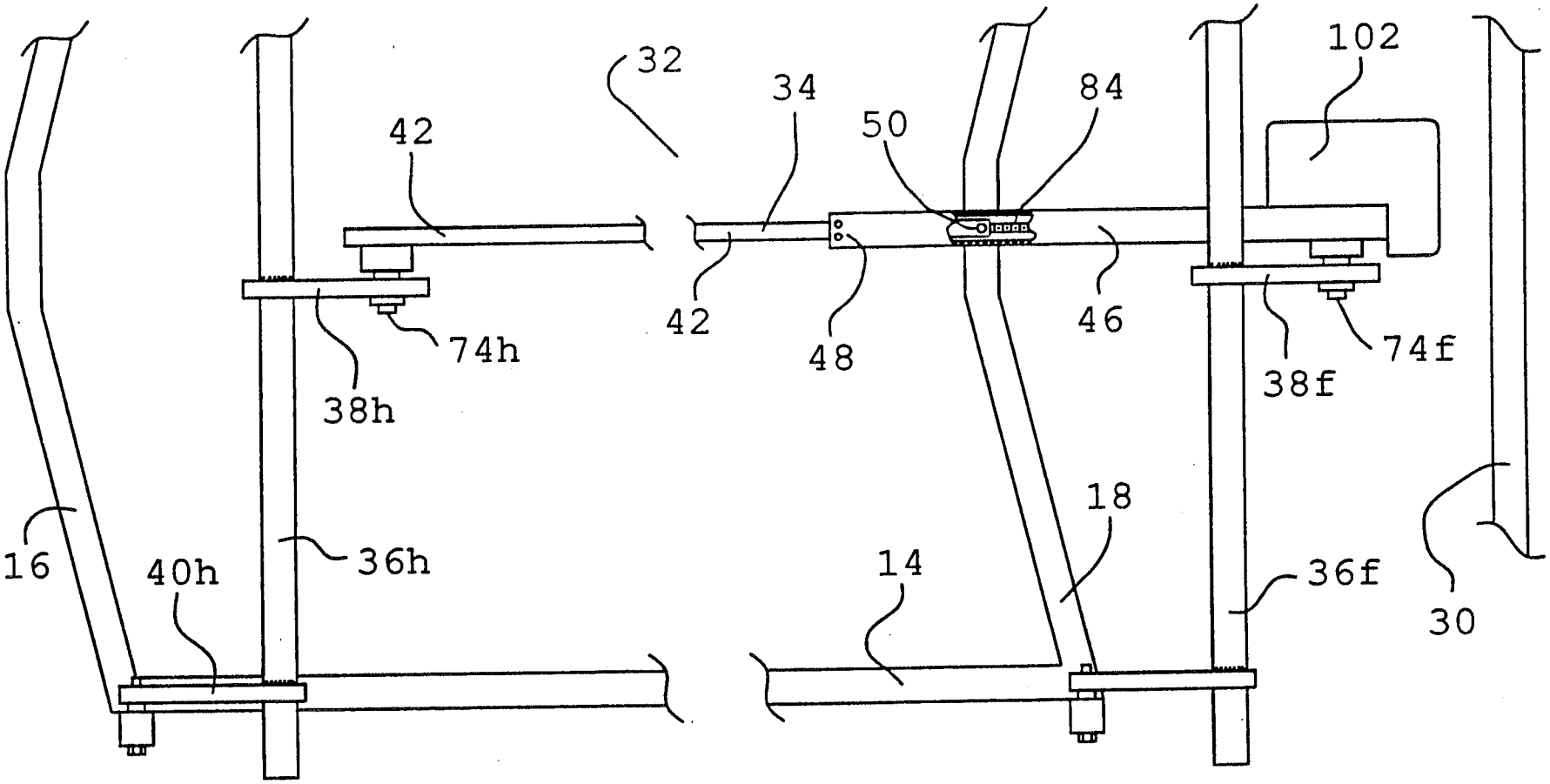
FIG. 10 is a partial plan view of the frame of a bed incorporating a second alternative embodiment of the apparatus of the invention, configured so as to support the mattress in a horizontal plane, with the moveable frame, mattress support structure, and mattress omitted, and with mechanisms for segmentally adjusting the mattress support structure and mattress omitted.
Figure 11:
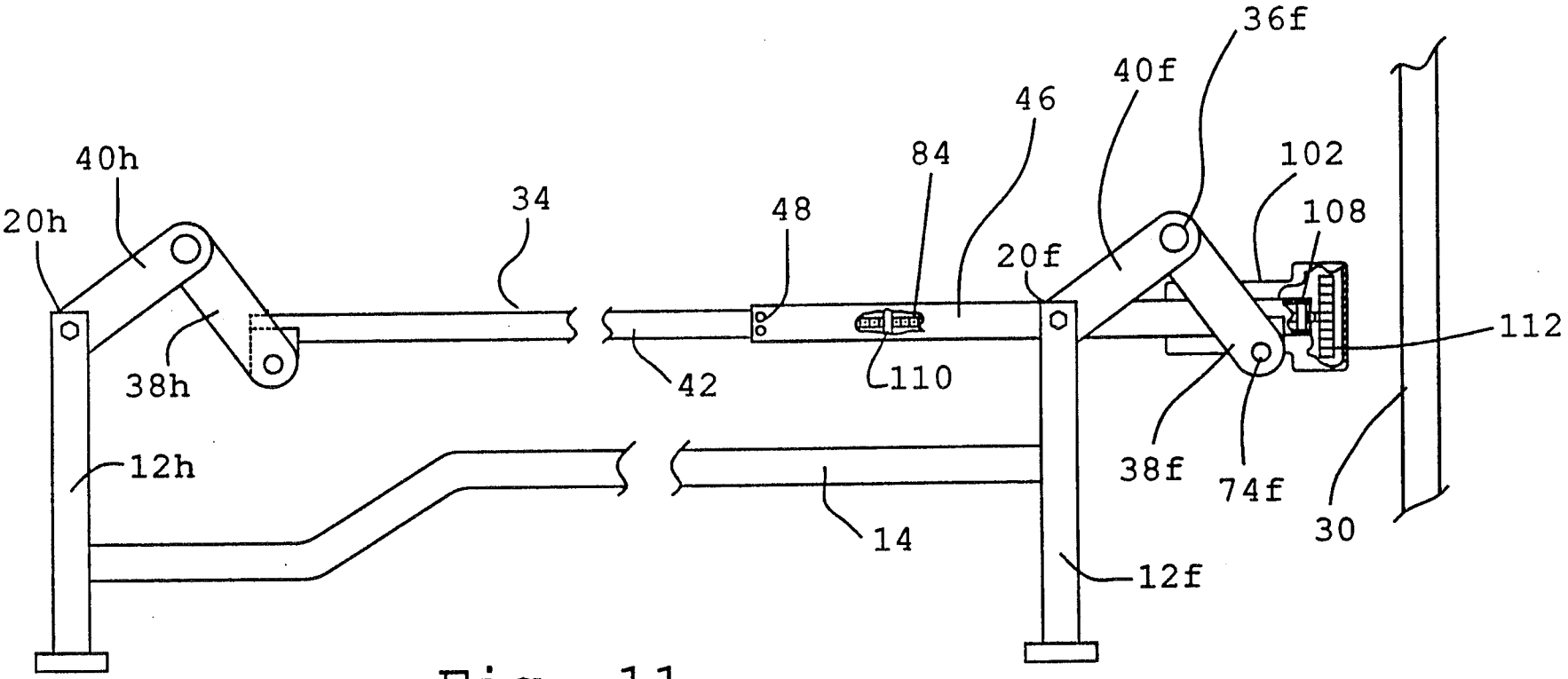
FIG. 11 is a side elevation view of the frame of a bed incorporating the second alternative embodiment illustrated in FIG. 10, configured so as to support the mattress in a horizontal plane, with the moveable frame, mattress support structure, and mattress omitted, and with mechanisms for segmentally adjusting the mattress support structure and mattress omitted.

Selective raising and lowering of e the head or the foot of the mattress support and mattress achieved through the use of a second alternative embodiment tilting apparatus 32, illustrated in FIGS. 10 and 11. In the second alternative embodiment, the structure of tilting apparatus 32 is simplified, but the ability to simultaneously raise and both head and foot of mattress support 24 and mattress 26 is sacrificed. Specifically, actuating means 76 utilized in the preferred and first alternative embodiments is omitted, a both locking mechanisms 52 and head bar 44 of lifting bar 34. For consistency, the same terminology and reference numerals used to identify components of the preferred and first alternative embodiments of the apparatus of the invention will be use the following description of the components of the second alternative embodiment. For example, reference will still be made to center bar 42, though head bar 44 of the preferred first alternative embodiments has been omitted, and lifting bar 34 of the second alternative embodiment comprises only two coaxially aligned bars.

Center bar 42, which continues to be received in the interior of foot bar 46 as in the preferred a first alternative embodiments, extends fully to first lever arm **38*h* and is pivotally interconnected thereto in the same manner as is head bar 44 of the preferred and first alternative embodiments. Elongate threaded rod 84 extends into the interior of foot bar 46 from its second end, with the second end threaded rod 84 extending from the second end of foot bar 46. Threaded rod 84 is allowed to rotate relative to foot bar 46 but restrained from longitudinal movement relative thereto by bearing 108 disposed at or near the second end of foot ba 6. Threaded rod 84 extends through foot bar 46 and into the interior of center bar 42 from its second end, which is dispose the interior of foot bar 46. The first end of threaded 84 is threaded through a threaded nut 110 rigidly in the interior of center bar 42 intermediate its first second ends. Reversible electric motor 102 is to the second end of of foot bar 46 with the longitudinal of its rotating output shaft parallel to the longitudinal axis of threaded rod 84, and the output shaft of motor 102 is operatively connected to the second end of threaded rod 84 by convenient conventional means, such as gear assembly 112**.

To raise the head of the mattress of bed 10 from its lowest position using the second alternative embodiment of the apparatus of the invention, motor 102 is activated to induce rotation of threaded rod 84 so as to push center bar 42 from the interior of foot bar 46 and increase the overall length of lifting bar 34. The elongation of lifting bar 34 imposes force on center bar 42, and thus on first lever arm **38*h*, toward the head of bed 10 and imposes force on foot bar 46, and thus on first lever arm toward the foot of bed 10. Because of the configuration of the respective first lever arms 38, second lever arms 40, and torque tubes 36 relative to the stationary frame of bed 10, there is a net upward force on level arms 38*h* and 40*h* and torque tube 36*h* and a net downward force on lever arms 38*f* and 40*f* and torque tube 36*f* in response to the elongation of lifting bar 34. Since the foot of bed 10 is at its lowest position no further downward movement is permitted, and there is no movement of lever arms 38*f* and 40*f* and torque tube 36*f* in response to the imposed force, while the upward force on the matching components associated with the head of the bed causes lever arms 38*h* and 40*h* to rotate about their pivotal interconnections to the first end of center bar 42 and legs 12*h*, respectively, resulting in a net upward movement of the head of mattress support 24 and mattress 26. The head of mattress support 24 and mattress 26 is lowered by reversing the operation of motor 102 and thus the rotation of threaded rod 84** until the head of the mattress support and mattress return to their lowest position.

To raise and lower the foot of mattress support 24 and mattress 26 from its lowest horizontal position using the second alternative embodiment, motor 102 is activated to telescope center bar 42 farther into the interior of foot bar 46 and decrease the overall length of lifting bar 34, reversing the direction of forces imposed by elongation of lifting bar 34 on first and second lever arms 38 and 40 and the interconnecting torque tubes 36. With the direction of forces reversed, there is a net downward force imposed on lever arms **38*h* and 40*h* and torque tube 36*h*, and a net upward force imposed on lever arms 38*f* and 40*f* and torque tube 36*f*. As described above, no downward movement of those components at the head of bed 10 is permitted, and lever arms 38*f* and 40*f* are caused to rotate about their pivotal interconnections, resulting in a net upward movement of the foot of mattress support 24 and mattress 26. Lowering of the foot of mattress support 24 and mattress 26 is achieved by reversing the direction of rotation of threaded rod 84**, allowing the foot of those components to return to their lowest positions.

The head and foot of mattress support 24 and mattress 26 will remain in the relative positions reached when activation of motor 102 is interrupted, since the combined weight of the mattress support, mattress, and occupant of the bed is not sufficient to induce rotation of threaded rod 84 against the resistance of threaded nut 110 and motor 102. It will also be understood that the configuration of the tilting apparatus of the second alternative embodiment may be reversed from end to end, with motor 102 disposed near the head of the bed rather than the foot, without departing from the scope of the invention.

The foregoing detailed description of the preferred and certain alternative embodiments has been for purposes of illustration and not limitation, and it will be understood that the invention is susceptible to various other alternative embodiments and modifications without departing from the scope of the invention as claimed. For example, the preferred and first alternative embodiments of the apparatus of the invention may be limited achieve raising and lowering only the head or only the foot of the moveable frame, mattress support, and mattress by omitting either the foot bar or the head bar, respectively, and its associated locking mechanism.

What is claimed is:

1. An apparatus for raising and lowering the head and/or foot of the mattress and mattress supporting structure of a bed, the bed including a stationary frame having a end and a foot end, with a pair of first legs, each having a lower end and an upper end, disposed at the head end of the stationary frame in opposed relation across the longitudinal axis of the stationary frame, a pair of second legs, each having a lower end and an upper end, disposed at the foot end of the stationary frame in opposed relation across the longitudinal axis of the stationary frame, and further including a substantially planar moveable frame, adapted to receive a mattress thereon, having a head end and a foot end, to be moveably interconnected to the stationary frame, the moveable frame disposed above the stationary frame with the longitudinal axis of the moveable frame parallel to the longitudinal axis of the stationary frame the apparatus comprising a first torque tube extending across the width of the moveable frame of the bed near the head end thereof with the longitudinal axis of said first torque tube perpendicular to the longitudinal axis of the moveable frame, and interconnected thereto such that said first torque tube is allowed to rotate relative to the moveable frame;

a second torque tube extending across the width of the moveable frame near the foot end thereof with the longitudinal axis of said second torque tube perpendicular to the longitudinal axis of the moveable frame, and interconnected thereto such that said second torque tube is allowed to rotate relative to the moveable frame;

a pair of first lever arms, each rigidly interconnected at one end thereof to a respective end of said first torque tube, and each pivotally interconnected at the opposite end thereof to the upper end of a respective one of the first legs of the bed such that the longitudinal axes of said first lever arms are in parallel relation;

a pair of second lever arms, each rigidly interconnected at one end thereof to a respective end of said second torque tube, and each pivotally interconnected at the opposite end thereof to the upper end of a respective one of the second legs such that the longitudinal axes of said second lever arms are in parallel relation;

an elongate lifting bar disposed under the moveable frame with its longitudinal axis parallel to the longitudinal axes of the stationary frame and of the moveable frame, respectively, said lifting bar having a center bar, a head bar slideably disposed in telescoping relation to said center bar with the head end of said head bar extending beyond the head end of said center bar, a foot bar slideably disposed in telescoping relation to said center bar with the foot end of said foot bar extending beyond the foot end of said center bar, a first locking means for selectively locking the position of said head bar relative to said center bar, and a second locking means for selectively locking the position of said foot bar relative to said center bar;

a third lever arm pivotally interconnected to the head end of said head bar and rigidly interconnected to said first torque tube intermediate its two ends, with the longitudinal axis of said third lever arm approximately perpendicular to the longitudinal axes of said first lever arms;

a fourth lever arm pivotally interconnected to the foot end of said foot bar and rigidly interconnected to said second torque tube intermediate its two ends, with the longitudinal axis of said fourth lever arm approximately perpendicular to the longitudinal axes of said second lever arms; and actuating means, with first and second ends, pivotally interconnected at its first end to said center bar of said lifting bar so as to allow pivotal movement of said actuating means relative to said center bar while preventing rotational movement of said actuating means about its longitudinal axis relative to said center bar rigidly interconnected to one end of said moveable frame, for the purpose of actuating movement of said center bar and of either of both of said head bar and foot bar selectively locked relative to said center bar, relative to the moveable frame, thereby actuating rotation of said lever arms about their pivotal interconnections to selectively induce vertical movement of either end or both ends of the moveable frame relative to the stationary frame.

2. The apparatus of claim 1, wherein said actuating means comprises a first hollow tube with first and second ends, pivotally interconnected at its first end to said center bar of said lifting bar so as to allow pivotal movement of said first tube relative to said center bar while preventing rotational movement of said first tube about its longitudinal axis and having a threaded nut interconnected in the interior thereof intermediate its first and second ends, a second hollow tube with first and second ends, with the second end of said first tube extending into the interior of said second tube from the first end thereof in telescoping relation and with the second end of said second tube interconnected in a fixed position relative to the moveable frame of the bed, an elongate threaded rod having first and second ends with its first end extending into the interior of said second tube from the second end thereof and into the interior of said first tube through said threaded nut in mating relation therewith, and with its second end extending a short distance from the second end of said second tube, said threaded rod being restrained relative to said second tube so as to allow rotational movement of said threaded rod relative to said second tube while preventing longitudinal movement thereof, and activating means for inducing rotation of said threaded rod relative to said first and second tubes and relative to said nut, thereby causing longitudinal movement of said first tube relative to said second tube and thus movement of said lifting bar through the interconnection between said first tube and said center bar of said lifting bar.

3. The apparatus of claim 2, wherein the moveable frame of the bed includes a footboard at the foot end of the bed, wherein the second end of said second tube is interconnected to said footboard and said threaded rod extends from said second end of said second tube through an aperture in said footboard, and wherein said activating means for inducing rotation of said threaded rod comprises a manually operated crank handle.

4. The apparatus of claim 2, wherein said activating means for inducing rotation of said threaded rod comprises a reversible electric motor.

5. The apparatus of claim 1, wherein said head bar is penetrated near its second end by an aperture extending into the interior thereof, said foot bar is penetrated near its first end by an aperture extending into the interior thereof, said center bar is penetrated near its first end by an aperture extending into the interior thereof and is penetrated near its second end by an aperture extending into the interior thereof, with said aperture in said head bar alignable with said aperture at the first end of said center bar and with said aperture in said foot bar alignable with said aperture at the second end of said center bar, and wherein each of said first and second locking means comprises an elongate locking pin to be received through the respective aligned apertures of said head bar or said foot bar and said center bar, means of retaining and guiding said locking pin along the axis of the respective aperture in said head bar or said foot bar, a housing for said locking pin and for the retaining and guiding means, means of attaching said housing to said head bar or to said foot bar, respectively, and means for moving said locking pin along its longitudinal axis in and out of the respective aligned apertures of said head bar or said foot bar and said center bar to selectively lock and unlock said head bar or said foot bar relative to said center bar.

6. The apparatus of claim 5, wherein said means for moving said locking pin of each of said locking means comprises an elongate cable interconnected at one end to the end of said locking pin distal from the aperture of said head bar or foot bar, an elongate hollow cable sheath surround said cable, with said cable sheath interconnected at one end to said housing, and means of moving said cable longitudinally relative to said cable sheath so as to cause longitudinal movement of said locking pin relative to said housing.

7. The apparatus of claim 5, wherein said means for moving said locking pin of each of said locking means comprises an electrically activated solenoid interconnected to said housing with the end of said locking pin distal from the aperture of said head bar or said foot bar operatively interconnected to said solenoid, and means of activating said solenoid such that upon activation of said solenoid said locking pin is caused to move longitudinally in response to operation of said solenoid.

8. The apparatus of claim 1, adapted to raise and lower only the head end of the mattress and mattress supporting structure of the bed, wherein said head bar and its associated locking mechanism is omitted, said center bar is extended in length, and said third lever arm is interconnected between the head end of said center bar and said first torque tube.

9. The apparatus of claim 1, adapted to raise and lower only the foot end of the mattress and mattress supporting structure of the bed, wherein said foot bar and its associated locking mechanism is omitted, said center bar is extended in length, and said forth lever arm is interconnected between the foot end of said center bar and said second torque tube.

10. An apparatus for independently raising and lowering the head and the foot of the mattress and mattress supporting structure of a bed, the bed including a stationary frame having a head end and a foot end, with a pair of first legs, each having a lower end and an upper end, disposed at the head end of the stationary frame in opposed relation across the longitudinal axis of the stationary frame, a pair of second legs, each having a lower end and an upper end, disposed at the foot end of the stationary frame in opposed relation across the longitudinal axis of the stationary frame, and further including a substantially planar moveable frame, adapted to receive a mattress thereon, having a head end and a foot end, to be moveably interconnected to the stationary frame, the moveable frame disposed above the stationary frame with the longitudinal axis of the the moveable frame parallel to the longitudinal axis of the stationary frame, the apparatus comprising a first torque tube extending across the width of the moveable frame of the bed near the head end thereof with the longitudinal axis of said first torque tube perpendicular to the longitudinal axis of the moveable frame, and interconnected thereto such that said first torque tube is allowed to rotate relative to the moveable frame;

a second torque tube extending across the width of the moveable frame near the foot end thereof with the longitudinal axis of said second torque tube perpendicular to the longitudinal axis of the moveable frame, and interconnected thereto such that said second torque tube is allowed to rotate relative to the moveable frame;

a pair of first lever arms, each rigidly interconnected at one end thereof to a respective end of said first torque tube, and each pivotally interconnected at the opposite end thereof to the upper end of a respective one of the first legs of the bed such that the longitudinal axes of said first lever arms are in parallel relation;

a pair of second lever arms, each rigidly interconnected at one end thereof to a respective end of said second torque tube, and each pivotally interconnected at the opposite end thereof to the upper end of a respective one of the second legs such that the longitudinal axes of said second lever arms are in parallel relation;

an elongate hollow lifting bar disposed under the moveable frame with its longitudinal axis parallel to the longitudinal axes of the stationary frame and of the moveable frame, said lifting bar having a hollow open ended head bar and having a hollow open ended foot bar slideably disposed in coaxial telescoping relation with said head bar;

a third lever arm pivotally interconnected to the head end of said head bar and rigidly interconnected to said first torque tube intermediate its two ends, with the longitudinal axis of said third lever arm approximately perpendicular to the longitudinal axes of said first lever arms;

a fourth lever arm pivotally interconnected to the foot end of said foot bar and rigidly interconnected to said second torque tube intermediate its two ends, with the longitudinal axis of said fourth lever arm approximately perpendicular to the longitudinal axes of said second lever arms;

an elongate threaded rod with first and second ends, extending into the interior of said lifting bar from one end thereof, with the first end of said threaded rod extending outwardly from said one end of said lifting bar and retained relative thereto so as to allow rotational movement of said threaded rod but prevent longitudinal movement of said threaded rod relative to said lifting bar, and with the second end of said threaded rod threaded through a threaded nut rigidly interconnected in the interior of said lifting bar such that rotation of said threaded rod in one direction will cause said head bar and said foot bar of said lifting bar to telescope relative to each other so as to increase the length of said lifting bar and rotation of said threaded rod in the opposite direction will cause said head bar and said foot bar of said lifting bar to telescope relative to each other so as to decrease the length of said lifting bar; and a reversible motor rigidly interconnected to the end of said lifting bar from which said threaded rod extends, and operatively interconnected to said first end of said threaded rod such that activation of said motor will induce rotation of said threaded rod.

11. The apparatus of claim 10, wherein said reversible motor is an electric motor.

12. The apparatus of claim 10, wherein said reversible motor is an electric motor and wherein said apparatus further includes a motor controller disposed so as to be conveniently accessible for operation of said motor.

13. A bed having a mattress with a head end and a foot end, adapted such that the head end and/or the foot end of the mattress can be simultaneously or independently raised and lowered with the mattress in a planar configuration, comprising a stationary frame having a head end and a foot end, with a pair of first legs, each having end and an upper end, disposed at the head end of said stationary frame in opposed relation across the longitudinal axis of said stationary frame, a pair of second legs, each having a lower end and an upper end, disposed at the foot end of said stationary frame in opposed relation across the longitudinal axis of said stationary frame, a pair of longitudinal beams each extending between a first leg and a second leg parallel to the longitudinal axis of said stationary frame, and a pair of transverse beams, one extending between said first legs perpendicular to the longitudinal axis of said stationary frame and the other extending between said second legs perpendicular to the longitudinal axis of said stationary frame;

a substantially planar moveable frame, adapted to receive a mattress thereon, having a head end and a foot end, to be moveably interconnected to said stationary frame, said moveable frame disposed above said stationary frame with the longitudinal axis of said moveable frame parallel to the longitudinal axis of said stationary frame;

a first torque tube extending across the width of said moveable frame near the head end thereof with the longitudinal axis of said first torque tube perpendicular to the longitudinal axis of said moveable frame, and interconnected thereto such that said first torque tube is allowed to rotate relative to said moveable frame;

a second torque tube extending across the width of said moveable frame near the foot end thereof with the longitudinal axis of said second torque tube perpendicular to the longitudinal axis of said moveable frame, and interconnected thereto such that said second torque tube is allowed to rotate relative to said moveable frame;

a pair of first lever arms, each rigidly interconnected at one end thereof to a respective end of said first torque tube, and each pivotally interconnected at the opposite end thereof to the upper end of a respective one of said first legs such that the longitudinal axes of said first lever arms are in parallel relation;

a pair of second lever arms, each rigidly interconnected at one end thereof to a respective end of said second torque tube, and each pivotally interconnected at the opposite end thereof to the upper end of a respective one of said second legs such that the longitudinal axes of said second lever arms are in parallel relation;

an elongate lifting bar disposed under said moveable frame with its longitudinal axis parallel to the longitudinal axes of said stationary frame and of said moveable frame, respectively, said lifting bar having a center bar, a head bar slideably disposed in telescoping relation to said center bar with the head end of said head bar extending beyond the head end of said center bar, a foot bar slideably disposed in telescoping relation to said center bar with the foot end of said foot bar extending beyond the foot end of said center bar, a first locking means for selectively locking the position of said head bar relative to said center bar, and a second locking means for selectively locking the position of said foot bar relative to said center bar;

a third lever arm pivotally interconnected to the head end of said head bar and rigidly interconnected to said first torque tube intermediate its two ends, with the longitudinal axis of said third lever arm approximately perpendicular to the longitudinal axes of said first lever arms;

a fourth lever arm pivotally interconnected to the foot end of said foot bar and rigidly interconnected to said second torque lube intermediate its two ends, with the longitudinal axis of said fourth lever arm approximately perpendicular to the longitudinal axes of said second lever arms; and an actuating assembly including a first hollow tube with first and second ends, pivotally interconnected at its first end to said center bar of said lifting bar so as to allow pivotal movement of said first tube relative to said center bar while preventing rotational movement of said first tube about its longitudinal axis and having a threaded nut interconnected in the interior thereof intermediate its first and second ends, a second hollow tube with first and second ends, with the second end of said first tube extending into the interior of said second tube from the first end thereof in telescoping relation and with the second end of said second tube interconnected in a fixed position relative to the moveable frame of the bed, an elongate threaded rod having first and second ends with its first end extending into the interior of said second tube from the second end thereof and into the interior of said first tube through said threaded nut in mating relation therewith, and with its second end extending a short distance from the second end of said second tube, said threaded rod being restrained relative to said second tube so as to allow rotational movement of said threaded rod relative to said second tube while preventing longitudinal movement thereof, and activating means for inducing rotation of said threaded rod relative to said first and second tubes and relative to said nut, thereby causing longitudinal movement of said first tube relative to said second tube and thus movement of said lifting bar through the interconnection between said first tube and said center bar of said lifting bar.

14. The bed of claim 13, wherein the moveable frame of the bed includes a footboard at the foot end of the bed, wherein the second end of said second tube is interconnected to said footboard and said threaded rod extends from said second end of said second tube through an aperture in said footboard, and wherein said activating means for inducing rotation of said threaded rod comprises a manually operated crank handle.

15. The bed of claim 13, wherein said activating means for inducing rotation of said threaded rod comprises a reversible electric motor.

* * * * *